US010712120B1

(12) United States Patent
Wei

(10) Patent No.: US 10,712,120 B1
(45) Date of Patent: Jul. 14, 2020

(54) TOY GUN WITH FOREGRIP

(71) Applicant: Ho-Sheng Wei, New Taipei (TW)

(72) Inventor: Ho-Sheng Wei, New Taipei (TW)

( * ) Notice: Subject to any disclaimer, the term of this patent is extended or adjusted under 35 U.S.C. 154(b) by 0 days.

(21) Appl. No.: 16/796,166

(22) Filed: Feb. 20, 2020

(51) Int. Cl.
*F41B 11/70* (2013.01)
*F41B 11/89* (2013.01)
*F41B 11/723* (2013.01)

(52) U.S. Cl.
CPC ..... *F41B 11/70* (2013.01); *F41B 11/723* (2013.01); *F41B 11/89* (2013.01)

(58) Field of Classification Search
CPC ..... F41B 11/70; F41B 11/723; F41B 11/89
See application file for complete search history.

(56) References Cited

U.S. PATENT DOCUMENTS 4,164,929 A * 8/1979 Liepins ..... F41B 11/51 124/50
4,732,136 A * 3/1988 Ferri ..... F41B 11/646 124/67
5,529,050 A * 6/1996 D'Andrade ..... F41B 11/723 124/1
7,677,235 B2 * 3/2010 Zimmerman ..... F41B 11/646 102/502
8,251,051 B2 * 8/2012 Maggiore ..... A01M 3/00 124/40
9,273,925 B1 * 3/2016 Liao ..... F41A 17/36
9,354,020 B1 * 5/2016 Wong ..... F41B 11/89
9,587,903 B2 * 3/2017 Sullivan ..... F41A 9/71
10,054,389 B2 * 8/2018 Wei ..... F41B 11/89
10,132,592 B1 * 11/2018 Wei ..... F41B 11/723
10,393,472 B1 * 8/2019 Wei ..... F41B 11/51
2006/0191523 A1 * 8/2006 Paletz ..... F41B 11/646 124/67
2011/0120437 A1 * 5/2011 Tippmann, Jr. ..... F41B 11/721 124/74

FOREIGN PATENT DOCUMENTS

GB 833803 A * 4/1960 ..... F41B 11/51
WO WO-2019058526 A1 * 3/2019 ..... F41B 11/643

* cited by examiner

*Primary Examiner* — Joshua T Semick
(74) *Attorney, Agent, or Firm* — Chun-Ming Shih; HDLS IPR Services

(57) ABSTRACT

A toy gun (10) with a foregrip includes a gun body (1) having a barrel (11), a gas chamber (12) and a magazine (13); an air valve assembly (3) closing the gas chamber (12); a linkage bar assembly (4) having a trigger bar (41) driving the air valve assembly (3) to open gas chamber (12), a bar dial (42) and a return spring (43) between the gun body (1) and the bar dial (32); a trigger assembly (5) having a trigger member (51) with one end abutted the trigger bar (41) and another end pressed or released from the bar dial (42); and a dialing structure (6) having one end with a foregrip (61) moving horizontally relative to barrel (11) and another end with a link member (62) driving the feed assembly (2) to close or open magazine (13) and pressing or releasing trigger bar (41) and bar dial (42).

14 Claims, 8 Drawing Sheets

TOY GUN WITH FOREGRIP

BACKGROUND OF THE INVENTION

Field of the Invention

The technical field relates to a toy gun structure, in particular, to a toy gun with a foregrip.

Description of Related Art

Modern people tend to be busy at work and have great working pressure. Consequently, a lot of people choose to perform recreation activities to relieve their stresses. In addition, more people nowadays start to seek new and exciting recreation activities, and toy guns, such as BB guns, paintball guns and air guns etc., have become one of the main tools for those deciding to perform shooting trainings.

In addition, the auxiliary grips of guns can be classified into the commonly seen foregrips and reargrips, which are mainly installed on guns, automatic rifles, assault rifles, sniper rifles and submachine guns. The foregrip installed on a gun and moved laterally can be further used to stabilize the shooting and mitigate the impact of recoil force.

Nevertheless, most of the toy guns with foregrips currently available in the market adopt the fixed method for installing the foregrips onto the barrel, causing the outer appearance and operation of the foregrip far different from a real gun. Consequently, the question on how to design a foregrip of a mimic structure to a real gun is the key research and development focus of the inventor of the present invention.

In view of above, the inventor seeks to overcome the aforementioned drawback associated with the currently existing technology after years of research and development along with the utilization of academic theories, which is also the objective of the development of the present invention.

SUMMARY OF THE INVENTION

The present invention provides a toy gun with a foregrip, capable of using the outer appearance and operation of the foregrip to mimic the foregrip of a real gun, thereby achieve the objective of providing a toy gun with improved quality mimicking a real gun.

In an exemplary embodiment of the present invention, the present invention provides a toy gun with a foregrip, used for a gas cylinder and a bullet, the toy gun comprising: a gun body having a barrel, a gas chamber and a magazine, wherein the gas chamber and the magazine are connected to the barrel, the gas cylinder is placed inside the gas chamber, and the bullet is placed inside the magazine; a feed assembly arranged corresponding to the magazine; an air valve assembly closing the gas chamber; a linkage bar assembly comprising a trigger bar, a bar dial and a return spring, wherein the trigger bar and the bar dial are pivotally attached onto the gun body, the trigger bar is configured to drive the air valve assembly to open the gas chamber, and the return spring is elastically supported between the gun body and the bar dial; a trigger assembly comprising a trigger member, wherein the trigger member is pivotally attached onto the gun body, and the trigger member has one end abutted against the trigger bar and another end capable of being locked at, pressed onto or released from the bar dial; and a dialing structure movably mounted onto the gun body, wherein the dialing structure has one end equipped with a foregrip and another end equipped with a link member, the foregrip is configured to move horizontally relative to the gun body, and the link member is configured to drive the feed assembly to close or open the magazine and capable of pressing or releasing the trigger bar and the bar dial.

In view of the above, the foregrip can move forward and backward relative to the barrel, and the link member can be driven to guide other components to perform bullet reloading. Consequently, the outer appearance and operation of the foregrip are similar to the foregrip of a real gun in order to achieve the objective of providing a toy gun with improved quality mimicking a real gun.

DETAILED DESCRIPTION OF THE INVENTION

The following provides a detailed technical content of the present invention along with the accompanied drawings. However, the accompanied drawings are provided for reference and illustrative purpose only such that they shall not be used to limit the scope of the present invention.

Figure 1:
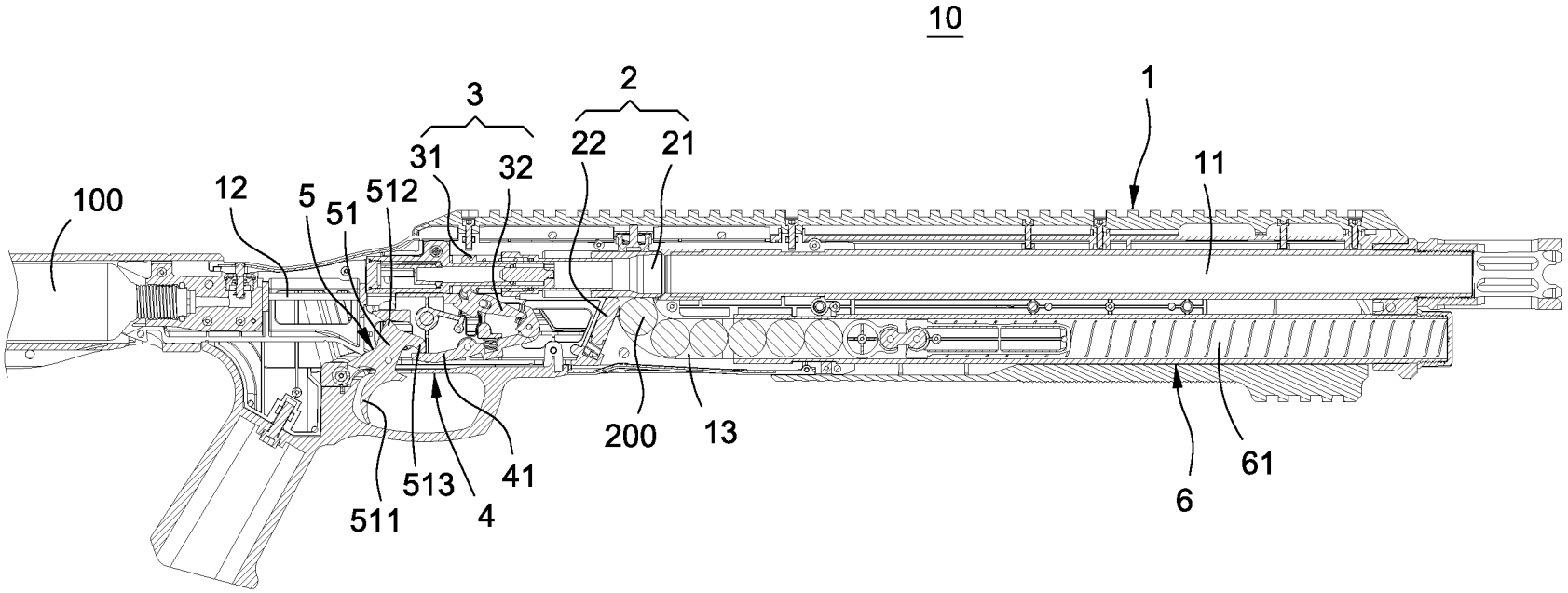
FIG. 1 is an assembly view of a toy gun of the present invention.
Figure 8:
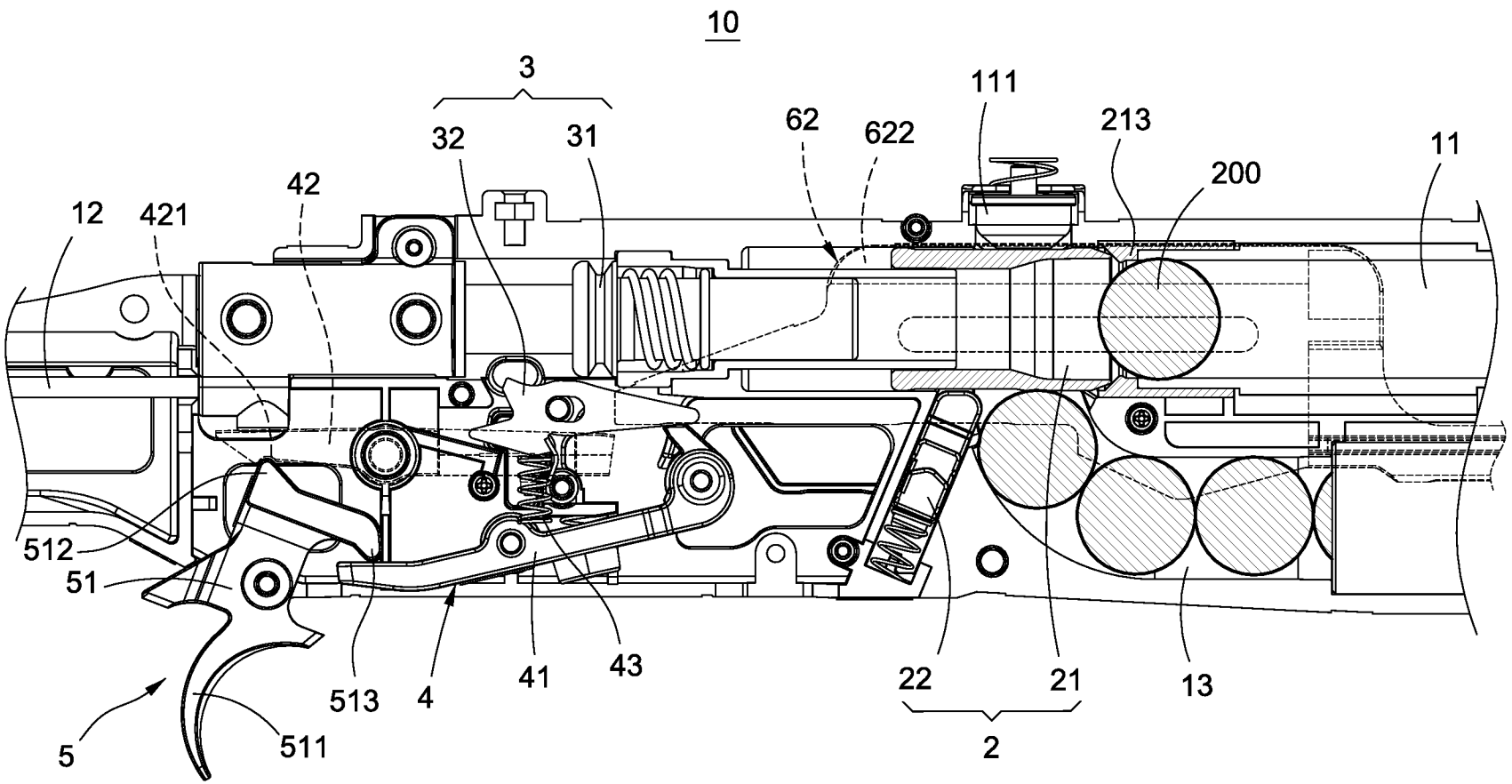
FIG. 8 is a schematic view showing the triggering piece of the present invention swinging from the ready-to-shoot position to the starting position.

Please refer to FIG. 1 and FIG. 8. The present invention provides a toy gun with a foregrip. The toy gun 10 mainly comprises a gun body 1, a feed assembly 2, an air valve assembly 3, a linkage bar assembly 4, a trigger assembly 5 and a dialing structure 6.

The gun body 1 includes a barrel 11, a gas chamber 12 and a magazine 13. The gas chamber 12 and the magazine 13 are connected to the barrel 11. The gas cylinder 100 is placed inside the gas chamber 12, and the bullet 200 is placed inside the magazine 13. In addition, the barrel 11 includes a feed positioning head 111 installed at an internal thereof. In addition, the gas cylinder 100 placed inside the gas chamber 12 has been pierced in order to allow the gas inside the gas cylinder 100 to flow out and to fill the internal of the gas chamber 12.

The feed assembly 2 is arranged corresponding to the magazine 13. The feed assembly 2 comprises a feed seat 21 and a loading latch 22. The feed seat 21 is configured to slide on the barrel 11 and is able to selectively close or open the magazine 13. The two sides of the feed seat 21 includes a left protrusion 211 and a right protrusion 212 extended therefrom respectively. The internal of the loading latch 22 includes a first return spring. The loading latch 22 is pushed upward by the first return spring installed at the internal thereof in order to allow the loading latch 22 to be elastically connected between the barrel 11 and the magazine 13 and to press the bullet 200.

The air valve assembly 3 closes the gas chamber 12. The air valve assembly 3 comprises an air valve sleeve 31, a sleeve latch 32, a second return spring and a third return spring. The air valve sleeve 31 is configured to slide on the barrel 11, and the second return spring drives the air valve sleeve 31 to selectively close or open the gas chamber 12. The sleeve latch 32 is pivotally attached onto the barrel 1. The third return spring drives the sleeve latch 32 to push the air valve sleeve 31 to close the gas chamber 12.

The linkage bar assembly 4 comprises a trigger bar 41, a bar dial 42 and a return spring 43. The trigger bar 41 and the bar dial 42 are pivotally attached onto the gun body 1. The trigger bar 41 is able to drive the air valve assembly 3 to open the gas chamber 12. The return spring 43 is elastically supported between the gun body 1 and the bar dial 42. The bar dial 42 includes a locking slot 421 formed thereon.

The trigger assembly 5 comprises a trigger member 51, and the trigger member 51 is pivotally attached onto the gun body 1. One end of the trigger member 51 abuts against the trigger bar 41 and another end can be locked at, pressed onto or released from the bar dial 42. Please refer to the following for further details. The bottom portion of the trigger member 51 includes a triggering piece 511 extended therefrom and the two ends of the top portion thereof includes a first press engagement portion 512 and a second press engagement portion 513. The trigger member 51 is configured to swing between a starting position where the triggering piece 511 rotates toward a direction away from the barrel 11 and a ready-to-shoot position where the triggering piece 511 rotates toward a direction approaching the barrel 11. The position of the second press engagement portion 513 is arranged to be closer to the barrel 11 than the position of the first press engagement portion 512. The first press engagement portion 512 is able to be locked onto or disengaged from the locking slot 421. The bar dial 42 is able to press or release the first press engagement portion 512. The second press engagement portion 513 abuts against the dial bar 41.

In addition, one end of the dial bar 41 abuts against the trigger member 51 and another end is arranged corresponding to the sleeve latch 32. The another end of the trigger bar 41 is able to push the sleeve latch 32 to release the air valve sleeve 31.

The dialing structure 6 is movably mounted onto the gun body 1. The dialing structure 6 includes one end equipped with a foregrip 61 and another end equipped with a link member 62. The foregrip 61 is configured to move horizontally relative to the gun body 11. The link member 62 is actuated along with the foregrip 61 in order to drive the feed assembly 2 to close or open the magazine 13. In addition, the foregrip 61 is able to press or release the trigger bar 41 and the bar dial 42.

The following provides further detailed description. The foregrip 61 and link member 62 are able to move sequentially among a first position, a second position and a third position away from the barrel 11. In addition, the link member 62 includes a left bar 621 slidably mounted onto an external of the left protrusion 211 and a right bar 622 slidably mounted onto an external of the right protrusion 212. The left bar 621 and the right bar 622 are able to move relative to the feed seat 21 or to drive the feed seat 21 to move.

Figure 2:
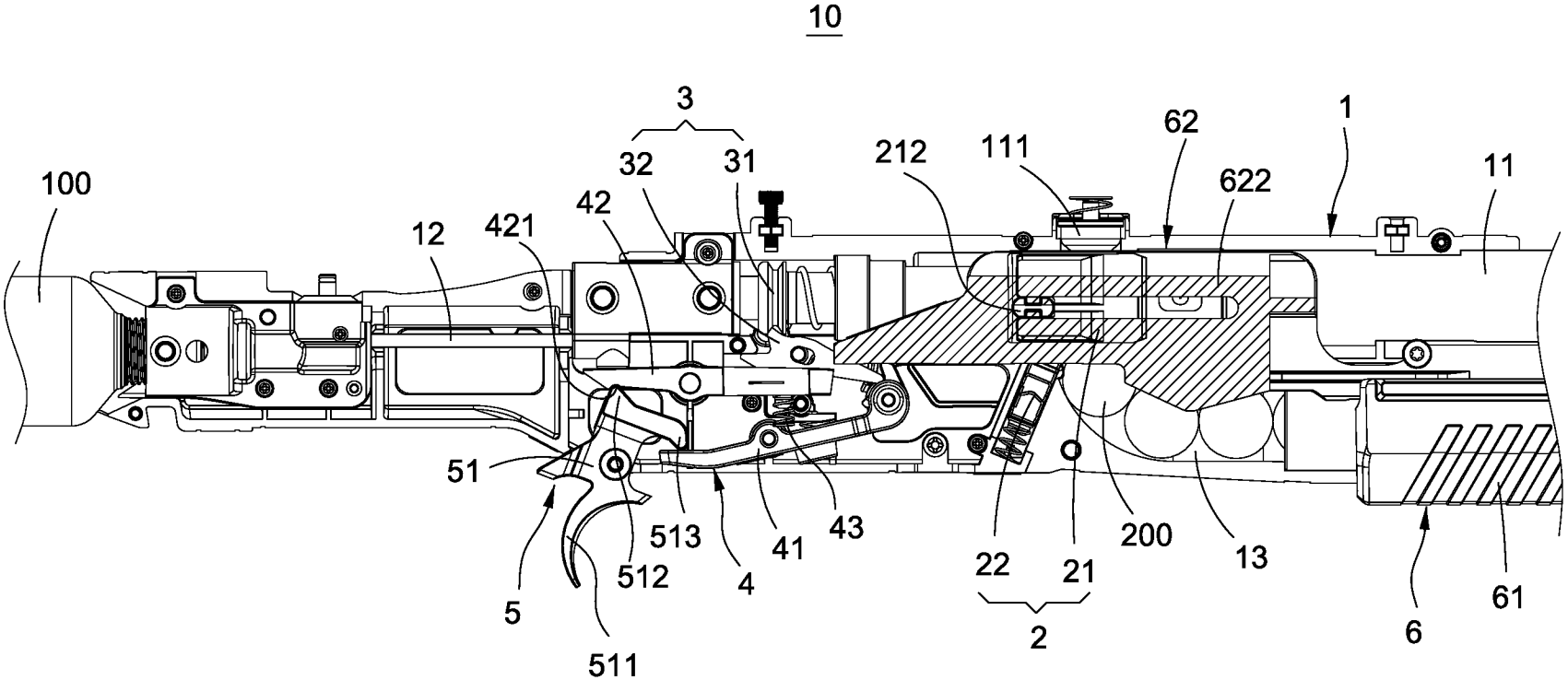
FIG. 2 is a schematic view showing the trigger member of the present invention at the starting position.
Figure 3:
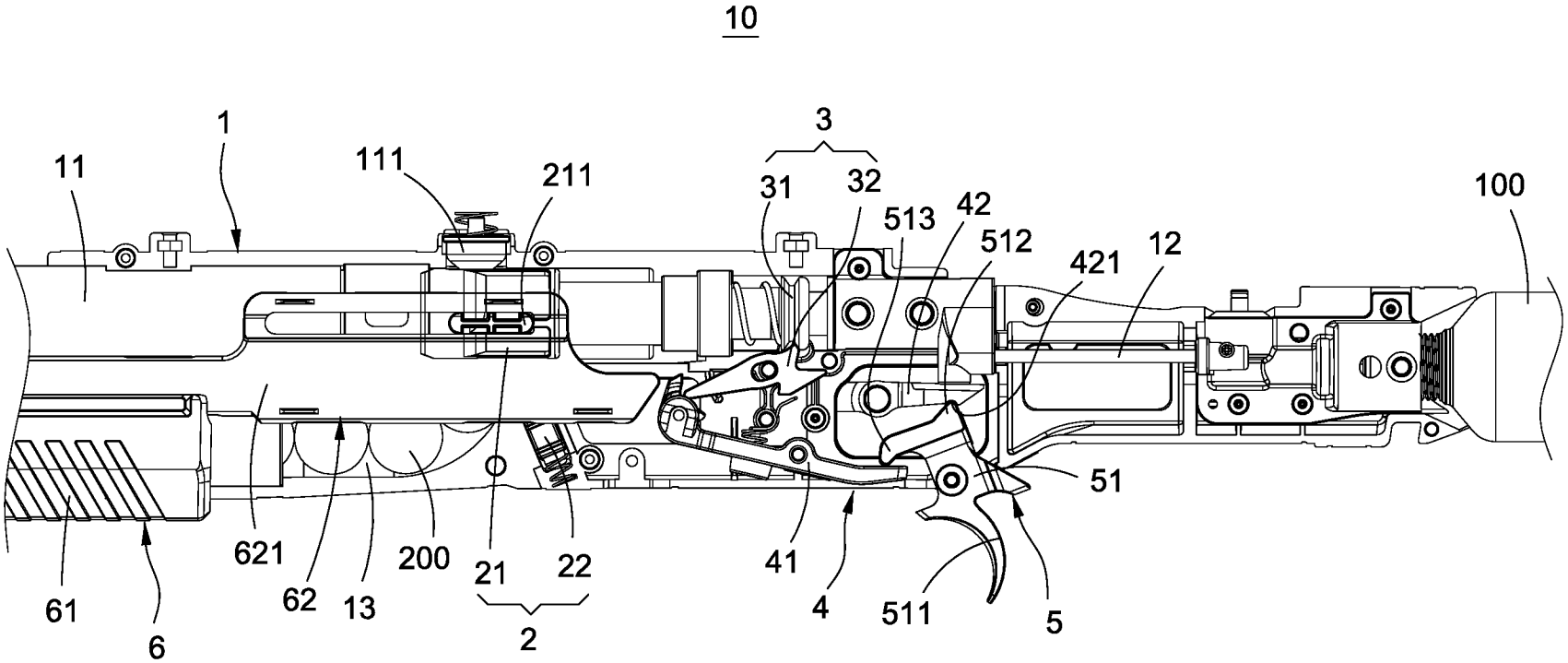
FIG. 3 is another schematic view showing the trigger member of the present invention at the starting position.

As shown in FIG. 1 to FIG. 8, the states of use of the toy gun 10 of the present invention are illustrated. As shown in FIG. 1 to FIG. 3, the bar dial 42 is pushed by the return spring to restore upward. The user can dial the triggering piece 511 to perform shooting, following which the triggering piece 511 rotates in a direction away from the barrel 11, and the first press engagement portion 512 is simultaneously driven to lock onto the locking slot 421 in order to be retained and positioned by the bar dial 42. Consequently, the trigger member 51 is positioned at the starting position by the locking slot 421 of the bar dial 42, and at this time, the user cannot dial the triggering piece 511.

Furthermore, the foregrip 61 and the link member 62 are at the first position, the feed seat 21 closes the magazine 13, and the sleeve latch 32 pushes the air valve sleeve 31 to close the gas chamber 12.

Figure 4:
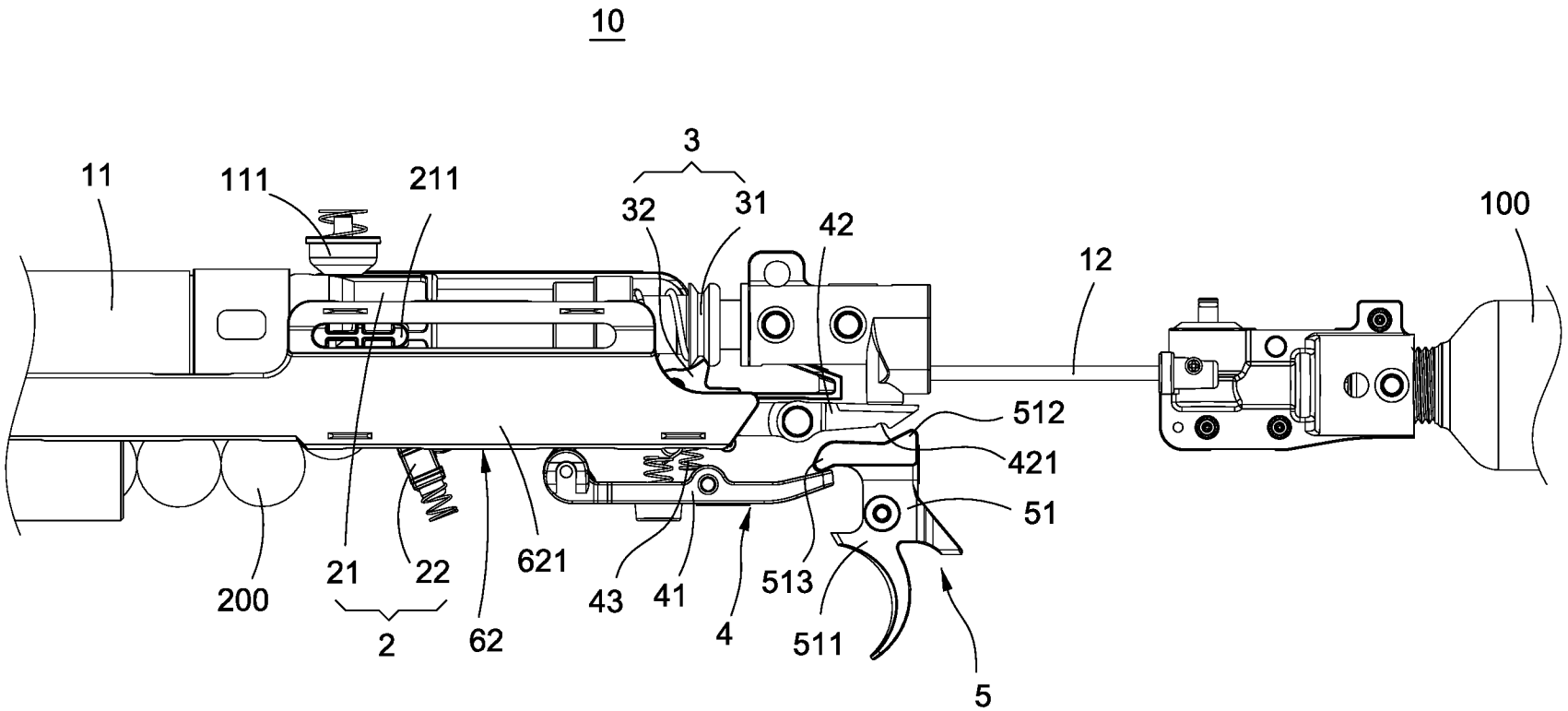
FIG. 4 is a schematic view showing the link member of the present invention moving from the first position to the second position.

Next, as shown in FIG. 4, when the foregrip 61 and the link member 62 move from the first position to the second position, i.e. the grip 61 and the link member 62 rotate in a direction away from the barrel 11, the left bar 621 moves relative to the left protrusion 211, the right bar 622 moves relative to the right protrusion 212 (as shown in FIG. 2), and the link member 62 does not drive the feed seat 21 to move; however, the right bar 622 is able to press onto the bar dial 42 (such that the return spring 43 cannot push the bar dial 42 to restore upward), in order to allow the first press engagement portion 512 to disengage from the locking slot 42 and to release the trigger member 51. At the same time, one end of the trigger bar 41 is pressed by the left bar 621 in order to drive the another end of the trigger bar 41 to push upward on the second press engagement portion 513, thereby allowing the triggering piece 511 to rotate in a direction toward the barrel 11 and allowing the trigger member 51 to be positioned at the read-to-shoot position. Furthermore, since the second press engagement portion 513 is pressed by the trigger bar 41 and the trigger bar 41 is pressed by the left bar 621, the user is still unable to dial the triggering piece 511. However, at this time, the trigger member 51 swings from the starting position to the ready-to-shoot position.

Figure 5:
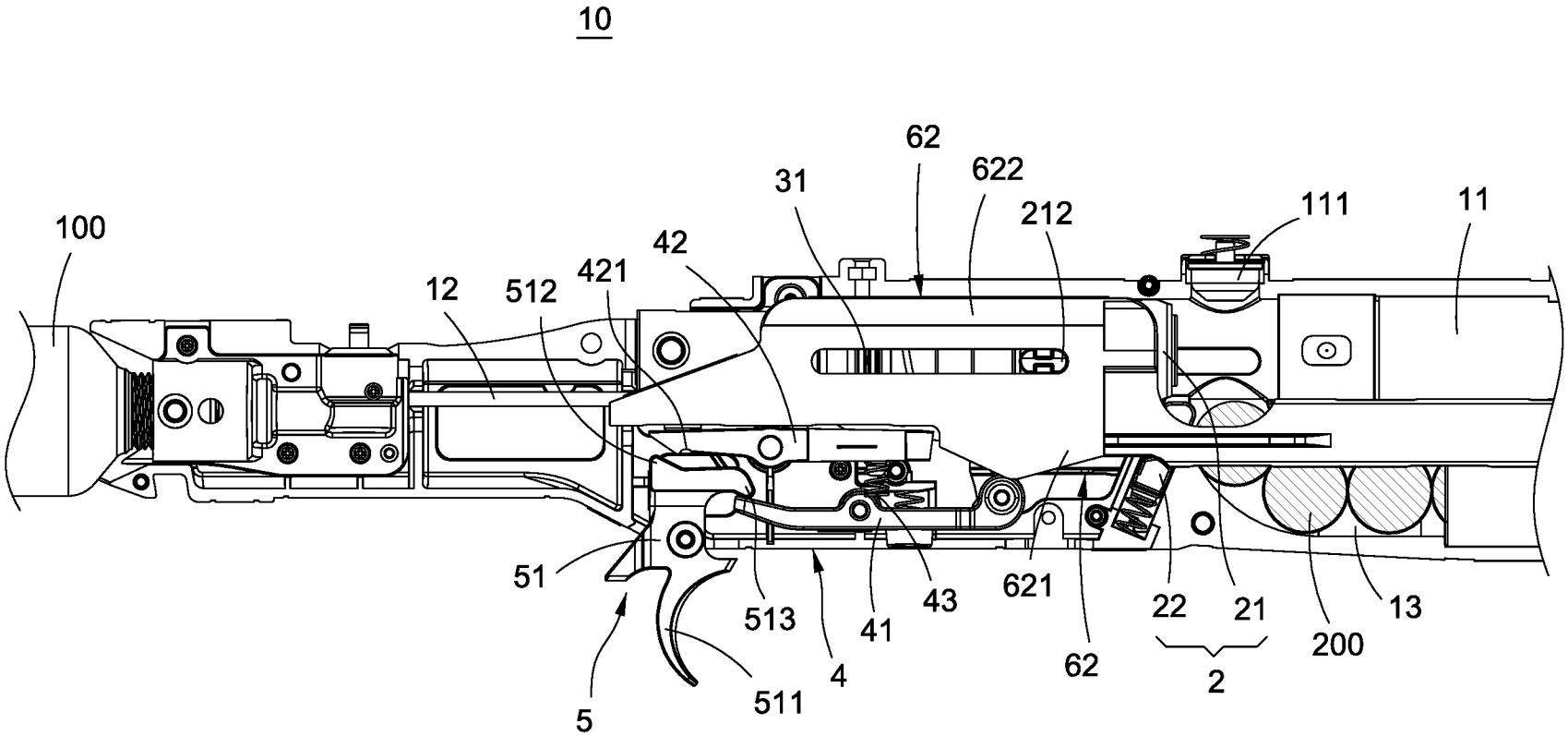
FIG. 5 is a schematic view showing the link member of the present invention moving from the second position to the third position.

Furthermore, as shown in FIG. 5, when the foregrip 61 and the link member 62 move from the second position to the third position, i.e. the foregrip 61 and the link member move in a direction away from the barrel 11 again, the left bar 621 is able to push the left protrusion 211 (as shown in FIG. 3), the right bar 622 is able to push the right protrusion 212 in order to allow the link member 62 to drive the feed seat 21 to move toward the direction of the trigger member 51, thereby opening the magazine 13. However, at this time, the bullet 200 is pressed and retained by the loading latch 22 such that the bullet 200 cannot be moved to the location between the barrel 11 and the magazine 13.

Figure 6:
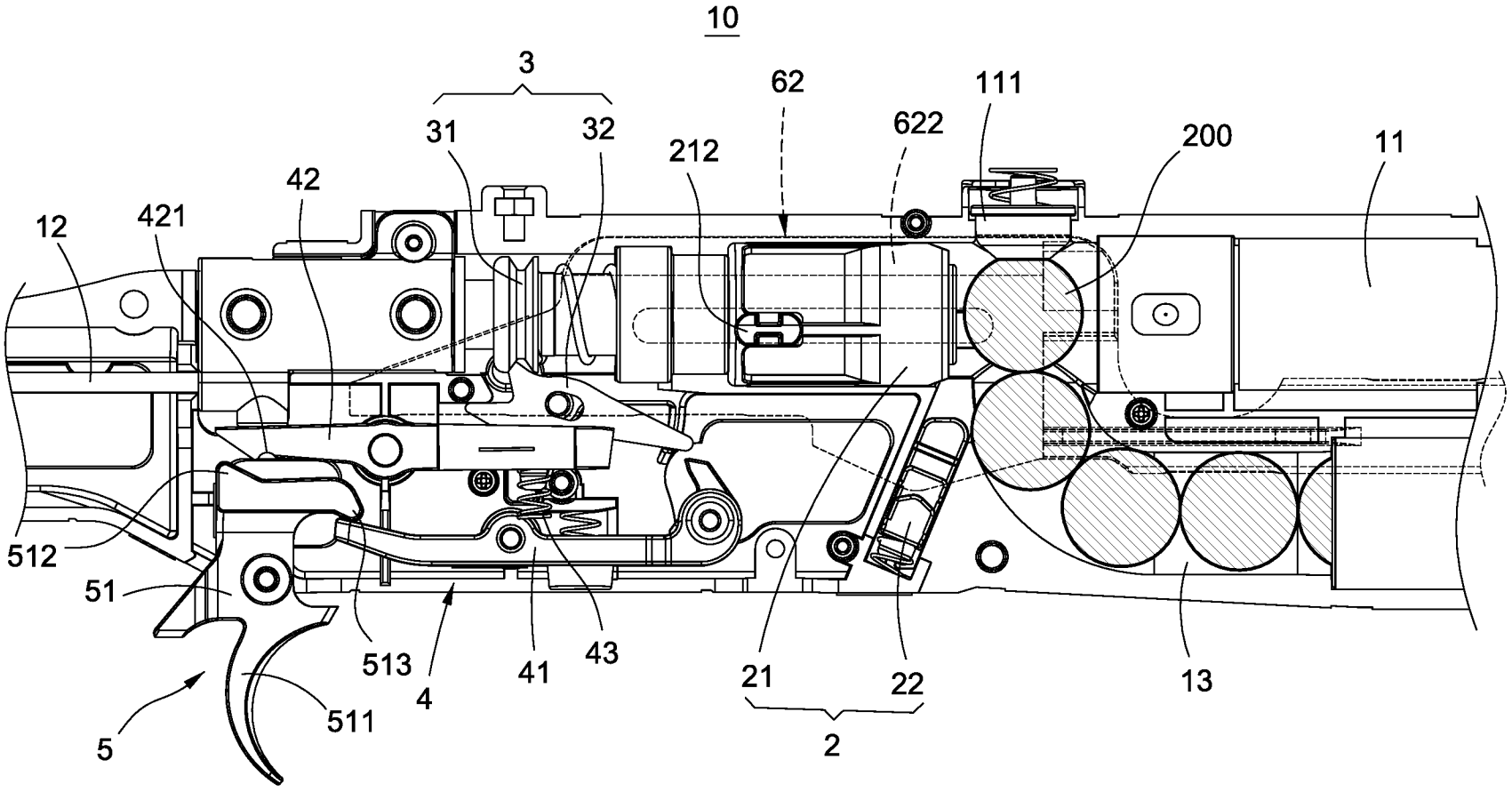
FIG. 6 is a schematic view showing the link member of the present invention moving from the third position to the second position.

In addition, as shown in FIG. 6, when the foregrip 61 and the link member 62 move from the third position to the second position, i.e. the foregrip 61 and the link member 62 move in a direction toward the barrel 11, the left bar 621 moves relative to the left protrusion 211 (as shown in FIG. 3), the right bar 622 moves relatively to the right protrusion 212, and the link member 62 does not drive the feed seat 21 to move. However, the right bar 622 presses the loading latch 22 to prevent the bullet 200 from being pressed and retained by the loading latch 22, allowing the bullet 200 to move between the barrel 11 and the magazine 13 as well as to be retained and positioned by the feed positioning head 111. The feed positioning head 11 is used to control that only one bullet 200 is permitted to enter into the barrel 11 while retaining the next bullet 200 inside the magazine 13.

Figure 7:
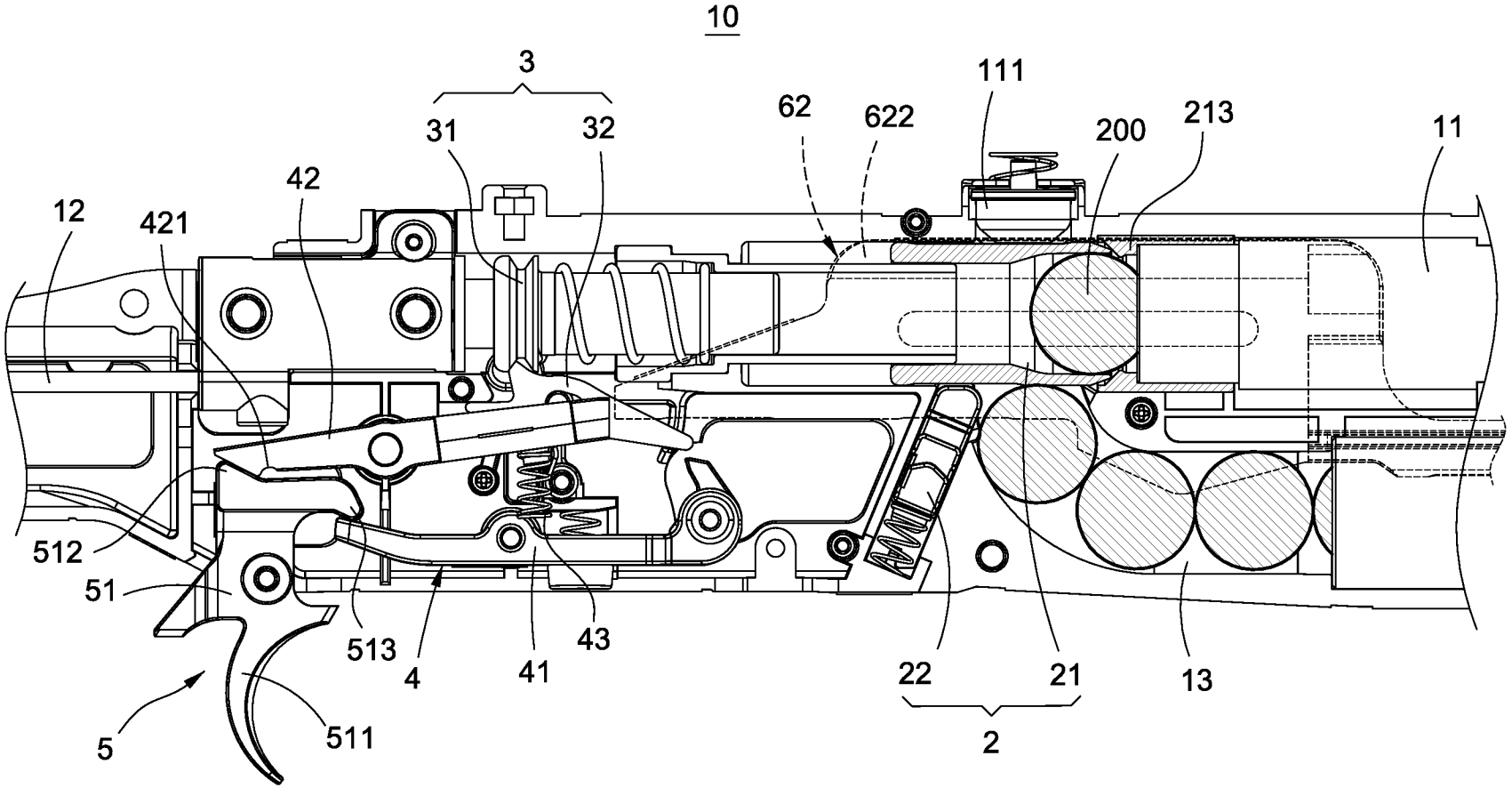
FIG. 7 is a schematic view showing the link member of the present invention moving from the second position to the first position.

Furthermore, as shown in FIG. 7, when the foregrip 61 and the link member 62 move from the second position to the first position, i.e. the foregrip 61 and the link member 62 move in a direction toward the barrel 11 again, the left bar 621 is able to push the left protrusion 211 (as shown in FIG. 3), the right bar 622 is able to push the right protrusion 212 in order to allow the link member 62 to drive the feed seat 21 to move in a direction toward the barrel 11, thereby closing the magazine 13 and pushing the bullet 200 into the barrel 11.

At the same time, the left bar 621 is able to release the trigger bar 41 in order to allow the trigger bar 41 to maintain its abutment but not to press the second press engagement portion 513 anymore. The right bar 622 is able to release the bar dial 42 such that the bar dial 42 is not subject to an external force such that it can be pushed upward by the return spring 43 for restoration, thereby pressing the first press engagement portion 512. In addition, the bar dial 42 exerts a force on the trigger member 51 to allow it to continue to swing toward the ready-to-shoot position; therefore, the trigger member 51 is changed to be retained by the bar dial 42 from the trigger bar 41 in order to be positioned at the ready-to-shoot position. However, since the trigger bar 41 does not press the second press engagement portion 513, and the bar dial 42 is not limiting the trigger member 51 to swing toward the starting position; consequently, the user is able to dial the triggering piece 511 in a direction away from the barrel 11.

Moreover, when one end of the bar dial 42 abuts against the first press engagement portion 512, it is able to drive another end of the bar dial 42 corresponding to the arrangement of the right bar 622 in order to be retained at the right bar 622.

Finally, as shown in FIG. 8, when the triggering piece 51 is dialed by the user in a direction away from the barrel 11 such that the trigger member 51 swings from the ready-to-shoot position to the starting position, the second press engagement portion 513 is able to press one end of the trigger bar 41 downward, thereby driving another end of the trigger bar 41 to push the sleeve latch 32 upward and driving the sleeve latch 32 to release the air valve sleeve 31 in order to open the gas chamber 12. Consequently, the gas of the gas chamber 12 can be released to flow into the barrel 11 to push the bullet out of the barrel 11, thereby completing one shot.

As shown in FIG. 1 to FIG. 8, the foregrip 61 of the present invention is able to move forward backward relative to the barrel 11 and to drive the link member 62 to guide the components of feed seat 21 and loading latch 22 etc. to perform bullet reloading. As a result, the outer appearance and operation of the foregrip 61 is able to mimic the foregrip of a real gun, thereby achieving the objective of the present invention of providing a toy gun 10 with improved quality mimicking a real gun.

In addition, when the foregrip 61 and the link member move from the second position to the first position, i.e. the bullet 200 enters into the barrel 11, the left bar 621 then changes from pressing the trigger bar 41 to releasing the trigger bar 41, thereby releasing the triggering piece 511 from the retention by the trigger bar 41 and allowing it to be further triggered for shooting. Accordingly, when the bullet 200 has not entered into the barrel 11, the triggering piece 511 is retained by the trigger bar 41 without permitting any dialing thereon, such that it is able to prevent accidental shooting before the reloading of the bullet 200 is complete. Consequently, the use safety of the toy gun 10 of the present invention is improved.

Furthermore, when the foregrip 61 and the link member 62 move from the second position to the first position and the trigger member 51 is at the ready-to-shoot position, the bar dial 42 is arranged corresponding to the right bar 622 in order to be retained by the right bar 622, i.e. the link bar 62 is retained by the bar dial 42 when it is moving toward the direction of the second position. Consequently, the foregrip 61 cannot be actuated and bullet is not reloaded repetitively in order to prevent jamming or misalignment of bullet 200 inside the barrel 11. It is until the triggering piece 511 is triggered for shooting, the foregrip 61 can then be successfully pulled, thereby enhancing the use safety of the toy gun 10 of the present invention.

Moreover, the external of the feed seat 21 includes an airtight gel 213 attached thereto. When the feed seat 21 pushes the bullet 200 into the barrel 11, it is able to also drive the airtight gel 213 to be filled among the barrel 11, the feed seat 21 and the feed positioning head 111 in order to increase the airtightness of the barrel 11, thereby allowing the bullet 200 to shoot out at a greater force.

In view of the above, the toy gun with a foregrip of the present invention is able to achieve the expected objective and purpose of use while overcoming the drawbacks of the prior arts. In addition, the present invention is of industrial applicability, novelty and inventive step such that it complies with the patentability. Accordingly, patent application is filed according to the Patent Act in light of the grant of the patent right for the protection of the rights of the inventor.

What is claimed is:

1. A toy gun with a foregrip, used for a gas cylinder (100) and a bullet (200), the toy gun (10) comprising:

a gun body (1) having a barrel (11), a gas chamber (12) and a magazine (13), wherein the gas chamber (12) and the magazine (13) are connected to the barrel (11), the gas cylinder (100) is placed inside the gas chamber (12), and the bullet (200) is placed inside the magazine (13);

a feed assembly (2) arranged corresponding to the magazine (13);

an air valve assembly (3) closing the gas chamber (12);

a linkage bar assembly (4) comprising a trigger bar (41), a bar dial (42) and a return spring (43), wherein the trigger bar (41) and the bar dial (42) are pivotally attached onto the gun body (1), the trigger bar (41) is configured to drive the air valve assembly (3) to open the gas chamber (12), and the return spring (43) is elastically supported between the gun body (1) and the bar dial (42);

a trigger assembly (5) comprising a trigger member (51), wherein the trigger member (51) pivotally is attached onto the gun body (1), and the trigger member (51) has one end abutted against the trigger bar (41) and another end capable of being locked at, pressed onto or released from the bar dial (42); and a dialing structure (6) movably mounted onto the gun body (1), wherein the dialing structure (6) has one end equipped with a foregrip (61) and another end equipped with a link member (62), the foregrip (61) is configured to move horizontally relative to the gun body (11), and the link member (62) configured to drive the feed assembly (2) to close or open the magazine (13) and capable of pressing or releasing the trigger bar (41) and the bar dial (42).

2. The toy gun with a foregrip according to claim 1, wherein the bar dial (42) includes a locking slot (421); a triggering piece (511) extends from a bottom portion of the trigger member (51); two ends of a top portion of the trigger member (51) includes a first press engagement portion (512) and a second press engagement portion (513); the first press engagement portion (512) is configured to be locked onto or disengaged from the locking slot (421); the bar dial (42) is configured to press or release the first press engagement portion (512); the second press engagement portion (513) abuts against the trigger bar (41).

3. The toy gun with a foregrip according to claim 2, wherein the trigger member (51) includes a triggering piece (511); the trigger member (51) is configured to swing between a starting position where the triggering piece (511) rotates toward a direction away from the barrel (11) and a ready-to-shoot position where the triggering piece (511) rotates toward a direction approaching the barrel (11); when the trigger member (51) is at the starting position, the first press engagement portion (512) is locked and positioned inside the locking slot (421).

4. The toy gun with a foregrip according to claim 3, wherein the feed assembly (2) comprises a feed seat (21) and a loading latch (22); the feed seat (21) is configured to slide on the barrel (11) and capable of closing or opening the magazine (13); the loading latch (22) is elastically connected between the barrel (11) and the magazine (13) and also presses the bullet (200).

5. The toy gun with a foregrip according to claim 4, wherein two sides of the feed seat (21) include a left protrusion (211) and a right protrusion (212) extended therefrom respectively; the link member (62) includes a left bar (621) slidably mounted onto an external of the left protrusion (211) and a right bar (622) slidably mounted onto an external of the right protrusion (212); the left bar (621) and the right bar (622) are configured to move relative to the feed seat (21) or to drive the feed seat (21) to move.

6. The toy gun with a foregrip according to claim 5, wherein the air valve assembly (3) comprises an air valve sleeve (31) and a sleeve latch (32); the air valve sleeve (31) is configured to slide on the barrel (11) and capable of closing or opening the gas chamber (12); the sleeve latch (32) is pivotally attached onto the gun body (1) and pushes the air valve sleeve (31) to close the gas chamber (12).

7. The toy gun with a foregrip according to claim 6, wherein the foregrip (61) is configured to move sequentially among a first position, a second position and a third position away from the barrel (11); when the foregrip (61) moves from the first position to the second position, the right bar (622) presses onto the bar dial (42) in order to allow the first press engagement portion (512) to disengage from the locking slot (42), thereby releasing the trigger member (51); one end of the trigger bar (41) is pressed by the left bar (621) in order to drive another end of the trigger bar (41) to push the second press engagement portion (513), thereby allowing the trigger member (51) to swing from the starting position to the ready-to-shoot position.

8. The toy gun with a foregrip according to claim 7, wherein when the foregrip (61) moves from the second position to the third position, the left bar (621) pushes the left protrusion (211), and the right bar (622) pushes the right protrusion (212) in order to allow the link member (62) to drive the feed seat (21) to open the magazine (13).

9. The toy gun with a foregrip according to claim 8, wherein when the foregrip (61) moves from the third position to the second position, the left bar (621) moves relative to the left protrusion (211), the right bar (622) moves relative to the right protrusion (212), and the right bar (622) presses the loading latch (22) in order to allow the bullet (200) to move between the barrel (11) and the magazine (13).

10. The toy gun with a foregrip according to claim 9, wherein the barrel (11) includes a feed positioning head (111) installed therein; the feed positioning head (111) retains and positions the bullet (200).

11. The toy gun with a foregrip according to claim 10, wherein when the foregrip (61) moves from the second position to the first position, the left bar (621) pushes the left protrusion (211), and the right bar (622) pushes the right protrusion (212) in order to allow the link member (62) to drive the feed seat (21) to close the magazine (13) and to push the bullet (200) into the barrel (11).

12. The toy gun with a foregrip according to claim 11, wherein when the left bar (621) releases the trigger bar (41), the bar dial (42) presses the first press engagement portion (512) in order to allow the trigger member (51) to be positioned at the ready-to-shoot position, and one end of the bar dial (42) abuts against the first press engagement portion (512) and another end arranged corresponding to the right bar (622) in order to be retained at the right bar (622).

13. The toy gun with a foregrip according to claim 12, wherein when the trigger member (51) swings from the ready-to-shoot position to the starting position, the second press engagement portion (513) presses one end of the trigger bar (41) downward in order to drive another end of the trigger bar (41) to push the sleeve latch (32) upward, and to drive the sleeve latch (32) to release the gas sleeve (31), thereby opening the gas chamber (12).

14. The toy gun with a foregrip according to claim 13, wherein an external of the feed seat (21) includes an airtight gel (213) attached thereto and capable of being filled among the barrel (11), the feed seat (21) and the feed positioning head (111).

* * * * *